US008479535B2

(12) United States Patent
Parsnick et al.

(10) Patent No.: US 8,479,535 B2
(45) Date of Patent: Jul. 9, 2013

(54) METHOD AND APPARATUS FOR PRODUCING HIGH PURITY OXYGEN

(75) Inventors: David Ross Parsnick, Amherst, NY (US); Richard David Karp, Goodyear, AZ (US)

(73) Assignee: Praxair Technology, Inc., Danbury, CT (US)

( * ) Notice: Subject to any disclaimer, the term of this patent is extended or adjusted under 35 U.S.C. 154(b) by 1270 days.

(21) Appl. No.: 12/235,029

(22) Filed: Sep. 22, 2008

(65) Prior Publication Data

US 2010/0071412 A1 Mar. 25, 2010

(51) Int. Cl.
*F25J 3/00* (2006.01)

(52) U.S. Cl.
USPC ..... 62/654; 62/640

(58) Field of Classification Search
USPC ..... 62/643, 654, 904, 652, 651, 656
See application file for complete search history.

(56) References Cited

U.S. PATENT DOCUMENTS

| | | | | | |
|---|---|---|---|---|---|
| 2,918,801 | A | * | 12/1959 | First et al. | 62/646 |
| 3,210,947 | A | * | 10/1965 | Lipman et al. | 62/651 |
| 3,363,427 | A | * | 1/1968 | Smith et al. | 62/656 |
| 4,410,343 | A | | 10/1983 | Ziemer | |
| 4,853,015 | A | * | 8/1989 | Yoshino | 62/656 |
| 4,869,741 | A | * | 9/1989 | McGuinness et al. | 62/645 |
| 4,934,147 | A | * | 6/1990 | Eyre | 62/656 |
| 4,994,098 | A | * | 2/1991 | Agrawal et al. | 62/646 |
| 5,315,833 | A | | 5/1994 | Ha et al. | |
| 5,337,570 | A | | 8/1994 | Prosser | |
| 5,546,767 | A | | 8/1996 | Dray et al. | |
| 5,551,258 | A | | 9/1996 | Rathbone | |
| 5,582,032 | A | * | 12/1996 | Shelton et al. | 62/643 |
| 5,628,207 | A | | 5/1997 | Howard et al. | |
| 5,669,236 | A | | 9/1997 | Billingham et al. | |
| 5,675,977 | A | | 10/1997 | Prosser | |
| 5,682,763 | A | * | 11/1997 | Agrawal et al. | 62/643 |
| 5,682,766 | A | | 11/1997 | Bonaquist et al. | |
| 5,836,174 | A | | 11/1998 | Billingham et al. | |
| 5,839,296 | A | * | 11/1998 | Bonaquist et al. | 62/650 |
| 5,896,755 | A | * | 4/1999 | Wong et al. | 62/643 |
| 5,916,262 | A | * | 6/1999 | Prosser et al. | 62/646 |
| 6,128,921 | A | * | 10/2000 | Guillard et al. | 62/643 |
| 6,622,520 | B1 | | 9/2003 | Prosser et al. | |

(Continued)

FOREIGN PATENT DOCUMENTS

EP 1544559 A1 * 6/2005

OTHER PUBLICATIONS

English translation of EP1544559.*

(Continued)

*Primary Examiner* — John Pettitt
*Assistant Examiner* — Ignacio E Landeros
(74) *Attorney, Agent, or Firm* — David M. Rosenblum

(57) ABSTRACT

A method and apparatus of producing high purity oxygen in connection with low purity liquid oxygen produced by a plurality of cryogenic air separation plants. The low purity liquid oxygen from the air separation plants is introduced into a distillation column of an auxiliary cryogenic rectification plant that is reboiled by nitrogen also produced by the air separation plants. Nitrogen is separated from the low purity liquid oxygen to produce high purity liquid oxygen from residual liquid located in a bottom region of the distillation column that can be taken as a product. Optionally, an argon column can be connected to the distillation column to produce a liquid argon product stream.

10 Claims, 1 Drawing Sheet

U.S. PATENT DOCUMENTS

| | | | | |
|---|---|---|---|---|
| 6,626,008 | B1 | 9/2003 | Prosser et al. | |
| 6,666,048 | B1 | 12/2003 | Brugerolle et al. | |
| 6,694,776 | B1 * | 2/2004 | Parsnick et al. | 62/643 |
| 2003/0033832 | A1 * | 2/2003 | Massimo et al. | 62/643 |
| 2006/0021380 | A1 | 2/2006 | Jaouani et al. | |

OTHER PUBLICATIONS

"Argon Recovery from a Low Purity Air Separation Unit", Technical Disclosure (2006).

* cited by examiner

METHOD AND APPARATUS FOR PRODUCING HIGH PURITY OXYGEN

FIELD OF THE INVENTION

The present invention relates to a method and apparatus for producing high purity oxygen in which low purity liquid oxygen is withdrawn from cryogenic air separation plants and rectified within a distillation column to produce the high purity liquid oxygen as a liquid column bottoms that can be withdrawn as a product or pumped and vaporized to produce a high purity gaseous oxygen product at pressure.

BACKGROUND OF THE INVENTION

There exists the need for low purity oxygen in many industrial processes, for example coal and petcoke gasification. For such processes, often an enclave of such plants is provided at a single location to supply the necessary low purity oxygen. In integrated gasification combined cycles, high pressure nitrogen is often required as a product that is used in enhancing the power of gas turbines and for NOx control. In some locations, there is also a desire to produce chemicals in addition to power generation from the gasification process. In such locations, there exists the need to produce a high pressure, high purity gaseous oxygen product. Moreover, there may also be a demand for argon.

Where oxygen is required for such purposes as gasification, the most practical way to produce the oxygen is by means of the cryogenic rectification of air. In such a process, the incoming air is compressed, purified and then cooled to a temperature suitable for its rectification within a main heat exchanger. The resulting compressed, cooled and purified air is then introduced into an air separation unit that typically consists of high and low pressure columns. In the high pressure column, the air is rectified to produce a nitrogen-rich column overhead. At least a portion of such column overhead is condensed to produce reflux to both the high and low pressure columns. An oxygen-rich column bottoms is produced within the high pressure column that is known as kettle liquid or crude liquid oxygen. A stream of such bottoms liquid is introduced into the low pressure column for further refinement. As a result of such further refinement, an oxygen-rich liquid column bottoms is produced in the low pressure column that can be taken as an oxygen-rich product.

An example of an air separation plant that can be used in the generation of low purity oxygen is disclosed in U.S. Pat. No. 5,675,977. In the plant shown in this patent, the nitrogen-rich vapor produced in the higher pressure column is in part condensed in a bottom reboiler located in the base of the lower pressure column to generate liquid reflux streams that are used to reflux both the higher and lower pressure columns. Another part of the nitrogen-rich vapor is taken as a high pressure product that is fully warmed in the main heat exchanger. A nitrogen product stream can also be taken at a lower pressure from the top of the low pressure column and fully warmed to produce a low pressure nitrogen product. A stream of oxygen-rich liquid is taken from the base of the low pressure column and optionally pumped and vaporized in the main heat exchanger to produce a high pressure oxygen product having a low purity. In order to generate sufficient reflux to enable production of the high pressure nitrogen product, the crude liquid oxygen or kettle liquid is taken as a stream and introduced into an auxiliary kettle liquid column for rectification. Nitrogen containing vapor from the top of the auxiliary column is used in reboiling the low pressure column at an intermediate point to generate liquid that is used in the reflux of both the auxiliary column and the low pressure column.

There are a variety of cryogenic air separation plants that are designed to produce both a low purity oxygen product and a higher purity oxygen product. For example, in U.S. Pat. No. 5,628,207, oxygen-rich column bottoms of the low pressure column is pumped and then introduced into an auxiliary column. This column is reboiled by compressing and cooling a portion of the nitrogen-rich vapor column overhead produced in the high pressure column. The resulting residual liquid is the ultra-high purity liquid oxygen that can be taken as a product. A gaseous stream can be removed from the top of the column and fully warmed to produce the low purity oxygen product.

It is to be noted that the air separation plant shown in U.S. Pat. No. 5,628,207, is a highly integrated plant in which all of the low purity oxygen is pumped and introduced into the auxiliary column for vaporization and for separation to produce the high purity liquid oxygen. Thus, although one plant in an enclave could be constructed using the teachings of this patent, it is not very amenable for a retrofit situation. Additionally, since all of the low purity oxygen passes through the auxiliary column, there is no way to provide an original installation where there exists a low requirement for high purity liquid oxygen and potentially argon.

As will be discussed, the present invention provides a method and apparatus for separating air that is more flexible in its production of high purity liquid oxygen and that is more amendable to the prior art in integrating such production with an existing enclave of cryogenic air separation plants. Moreover, the present invention allows argon contained in the low purity oxygen to be recovered.

SUMMARY OF THE INVENTION

The present invention provides a method of producing high purity oxygen from low purity oxygen. In this regard, the term "high purity oxygen" as used herein and in the claims means oxygen having a purity of above about 98 percent by volume and typically about 99.5 percent by volume. The term "low purity oxygen" as used herein and in the claims means oxygen having a purity of between about 75 and about 98 percent by volume.

In accordance with this method, low purity liquid oxygen streams and gaseous nitrogen streams are withdrawn from a plurality of cryogenic air separation plants. A combined low purity liquid oxygen stream formed from the low purity liquid oxygen streams and a combined gaseous nitrogen stream formed from the gaseous nitrogen streams are introduced into an auxiliary cryogenic rectification plant. Nitrogen is separated from the combined low purity liquid oxygen stream within a distillation column of the auxiliary cryogenic rectification plant such that the high purity oxygen is formed of residual liquid produced by reboiling bottoms liquid in a bottom region of the distillation column. The bottoms liquid is reboiled with the combined gaseous nitrogen stream, thereby to condense the combined gaseous nitrogen stream and to form a liquid nitrogen stream. The liquid nitrogen stream is introduced into a top region of the distillation column as reflux. Refrigeration is imparted to the auxiliary cryogenic rectification plant and is recovered through subcooling the liquid nitrogen stream and thereafter cooling the combined gaseous nitrogen stream through indirect heat exchange with a nitrogen-rich vapor stream withdrawn from a top region of the distillation column. The high purity oxygen is withdrawn from the bottom region of the distillation column as a high purity liquid oxygen stream.

The combined gaseous nitrogen stream can be compressed prior to being cooled and heat of compression can be removed from the combined gaseous nitrogen stream. The refrigeration can be imparted to the auxiliary cryogenic rectification plant by introducing a liquid nitrogen refrigerant stream into the distillation column as part of the reflux.

An argon containing stream can be withdrawn from the distillation column and introduced into an argon column of the auxiliary cryogenic rectification plant to separate oxygen from argon and thereby produce an argon-rich column overhead and an oxygen-rich liquid column bottoms. An argon-rich vapor stream is condensed to form an argon-rich liquid through indirect heat exchange with a heat exchange stream withdrawn from the distillation column, thereby to form a vaporized heat exchange stream. An argon-rich liquid product stream is formed from part of the argon-rich liquid and a remaining part of the argon-rich liquid is introduced into the argon column as an argon reflux stream. The vaporized heat exchange stream and an oxygen-rich liquid stream composed of the oxygen-rich liquid column bottoms are introduced back into the distillation column.

Part of the high purity liquid oxygen stream can be pumped to form a pumped liquid oxygen stream. The pumped liquid oxygen stream can be vaporized within a main heat exchanger associated with one of the cryogenic air separation plants.

In another aspect, the present invention provides an apparatus for producing high purity oxygen. In accordance with this aspect of the present invention, an auxiliary cryogenic rectification plant is connected to a plurality of cryogenic air separation plants to receive a combined low purity liquid oxygen stream formed from the low purity liquid oxygen streams produced by the cryogenic air separation plants and a combined gaseous nitrogen stream formed from the gaseous nitrogen streams produced by the cryogenic air separation plants.

The auxiliary cryogenic rectification plant has a distillation column configured such that nitrogen is separated from the combined low purity oxygen stream and the high purity oxygen is formed from residual liquid produced from reboiling bottoms liquid in a bottom region of the distillation column. A reboiler is located in a bottom region of the distillation column and is positioned such that the combined gaseous nitrogen stream passes through the reboiler to reboil the bottoms liquid and to produce a liquid nitrogen stream and the liquid nitrogen stream is introduced into the top region of the distillation column as reflux. A heat exchanger is connected to the reboiler such that the combined gaseous nitrogen stream is cooled prior to passing into the reboiler and a subcooling unit positioned between the reboiler and the top region of the distillation column such that the liquid nitrogen stream is subcooled prior to being introduced into the top region of the distillation column.

A means is provided for imparting refrigeration to the auxiliary cryogenic rectification plant. The subcooling unit is connected to the top region of the distillation column and the heat exchanger is connected to the subcooling unit such that a nitrogen rich stream produced at the top region of the distillation column passes in indirect heat exchange with the liquid nitrogen stream and thereafter, the combined gaseous nitrogen stream. As a result, the refrigeration is thereby recovered in subcooling the liquid nitrogen stream and in cooling the combined gaseous nitrogen stream. The distillation column has, at the bottom region thereof, an outlet to discharge the high purity oxygen as a high purity liquid oxygen stream.

A compressor can be positioned between the cryogenic air separation plants and the auxiliary cryogenic rectification plant such that the combined gaseous nitrogen stream is compressed. An after-cooler is connected to the compressor to remove the heat of compression from the combined gaseous nitrogen stream after having been compressed.

The refrigeration imparting means can be a liquid nitrogen refrigerant stream introduced into the top region of the distillation column as part of the reflux.

The auxiliary cryogenic rectification plant can be provided with an argon column and a condenser. The argon column is connected to the distillation column and is configured such that a argon containing stream is withdrawn from the distillation column and introduced into the argon column and oxygen is separated from argon, thereby to produce, within the argon column, an argon-rich column overhead and an oxygen-rich liquid column bottoms. The argon column is also connected to the distillation column such that an oxygen-rich liquid stream composed of the oxygen-rich liquid column bottoms is introduced back into the distillation column. The condenser is connected to the distillation column and the argon column such that an argon-rich vapor stream composed of the argon-rich column overhead is condensed to form an argon-rich liquid through indirect heat exchange with a heat exchange stream withdrawn from the distillation column. The heat exchange forms a vaporized heat exchange stream that is returned to the distillation column. An argon-rich liquid product stream is formed from part of the argon-rich liquid and a remaining part of the argon-rich liquid is introduced into the argon column as an argon reflux stream.

A pump can be provided in flow communication with the outlet of the distillation column so that part of the high purity liquid oxygen stream is pumped to form a pumped liquid oxygen stream. A main heat exchanger associated with one of the cryogenic air separation plants can be connected to the pump so that the pumped liquid oxygen stream vaporizes within the heat exchanger.

As is apparent from the above discussion, the present invention is amenable to be retrofitted to an enclave of low purity oxygen plants to a greater extent than prior art methodology in which multiple purity oxygen production is integrated into a single plant. Moreover, since the integration of the present invention utilizes an auxiliary cryogenic rectification plant, there is a wide latitude allowed in the construction of such a plant so that it can be appropriately sized to produce the high purity oxygen. In this regard, argon products can be added to the slate of such a plant if desired.

BRIEF DESCRIPTION OF THE DRAWINGS

While the specification concludes with claims distinctly pointing out the subject matter that Applicants regard as their invention it is believed that the invention will be better understood when taken in connection with the accompanying drawings in which:

DETAILED DESCRIPTION

Figure 1:
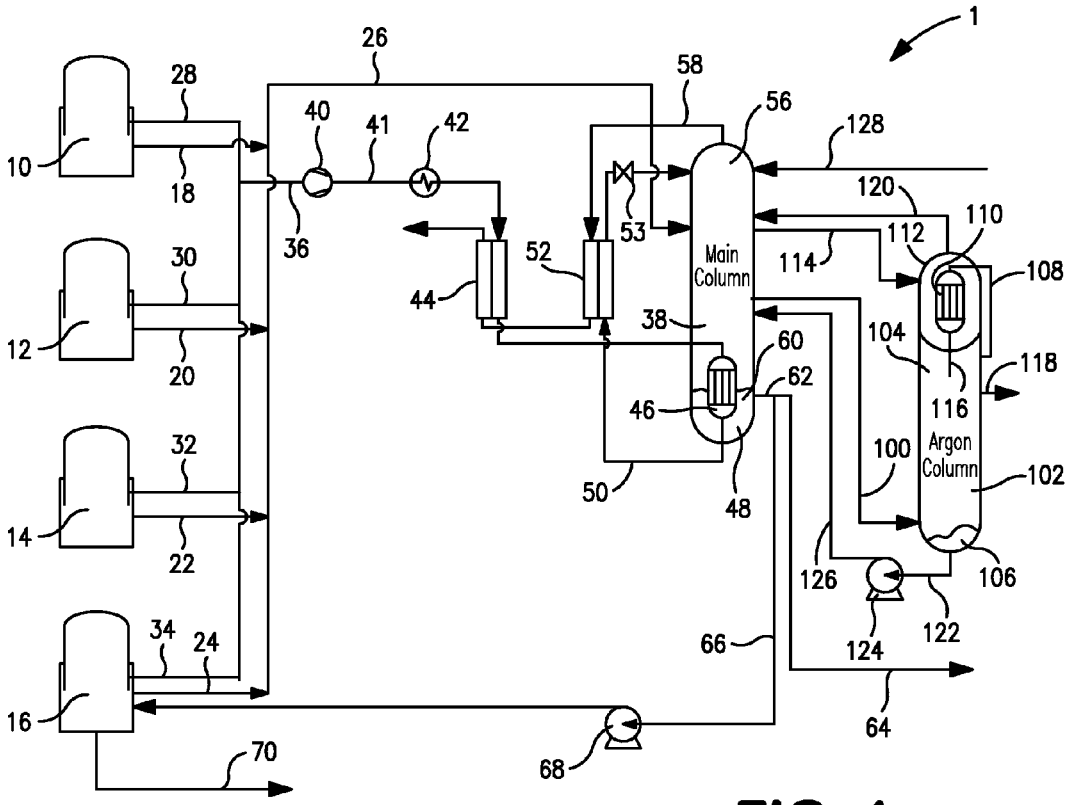
FIG. 1 is a process flow diagram of an apparatus that is designed to carry out a method in accordance with the present invention.

With reference to FIG. 1, a plurality of cryogenic air separation plants, designated by reference numerals 10, 12, 14 and 16, are illustrated that are designed to produce a low purity oxygen product. Although not illustrated, cryogenic air separation plants 10-16 could form an enclave of such plants to produce low purity oxygen for coal gasification. A plurality of low purity liquid oxygen streams, 18, 20, 22 and 24 are withdrawn from cryogenic air separation plants 10 through 16 and combined to form a combined low purity liquid oxygen stream 26. Further, a plurality of gaseous nitrogen streams 28, 30, 32 and 34 are also withdrawn from cryogenic air separation plants 10-16 and combined to form a combined gaseous nitrogen stream 36. As will be discussed, the combined low purity liquid oxygen stream 26 and the combined gaseous nitrogen stream 36 are introduced into an auxiliary cryogenic rectification plant 1.

Although not illustrated, but as would be appreciated by those skilled in the art, each of the cryogenic air separation plants 10-16 can be of any design that is capable of producing low purity liquid oxygen and gaseous nitrogen and the present invention is not intended to be limited to a particular type of plant. However, the plant design could for exemplary purposes be the type that is described in U.S. Pat. No. 5,675,977, the low purity liquid oxygen streams 18-24 could be formed from part of the low purity liquid oxygen formed as column bottoms within the low pressure column of such a plant.

The combined low purity liquid oxygen stream 26 is then introduced into a distillation column 38 ("Main Column") to separate nitrogen from such stream. Although not illustrated, distillation column 38 contains mass transfer contacting elements such as trays or packing, either structured or random packing, or combinations thereof, all as well known in the art.

The plurality of gaseous nitrogen streams 28, 30, 32 and 34, also withdrawn from the cryogenic air separation plants 10-16, could be formed from the type of plants illustrated in U.S. Pat. No. 5,675,977. In such case, each of the streams could be part of a stream of the nitrogen containing vapor that is produced in the auxiliary kettle column. As illustrated, the resulting combined gaseous nitrogen stream 36 is compressed within a compressor 40 to produce a compressed gaseous nitrogen stream 41. It is to be noted, however, that since the potential operating pressures of the plant illustrated in U.S. Pat. No. 5,675,977 cover a wide range, as do other low purity oxygen plants, the combined gaseous nitrogen stream 36 might be taken at a sufficiently high pressure that no further compression is necessary. However, in the illustrated embodiment, the resulting compressed gaseous nitrogen stream 41 is then cooled in an after-cooler 42 to remove the heat of compression and then further cooled within a heat exchanger 44 associated with distillation column 38 and the auxiliary cryogenic rectification plant 1.

The compressed nitrogen stream 41, after having been fully cooled, is then introduced into a reboiler 46 located in a bottom region 48 of distillation column 38 to reboil distillation column 38 and initiate the formation of the an ascending vapor phase. The ascending vapor phase will contact a descending liquid phase, initiated by introduction of reflux into distillation column 38, by means of the mass transfer contacting elements discussed above. The reboiling condenses the compressed nitrogen stream 41 and thereby produces a liquid nitrogen stream 50 that is then passed into a subcooling unit 52 and through a valve 53 to reduce the pressure thereof. Liquid nitrogen stream is then introduced into a top region 56 of distillation column 38 as reflux. It is to be noted that depending on the pressure drop produced by reboiler 46, the subcooling unit 52 and the associated piping, valve 53 might not be necessary.

A nitrogen-rich stream 58 is withdrawn from top region 56 of distillation column 38 and passed through subcooling unit 52 to subcool liquid nitrogen stream 50. Thereafter, nitrogen-rich stream 58 is passed through heat exchanger 44 to cool compressed nitrogen stream 40 prior to its introduction into reboiler 46. Thus, refrigeration that is imparted to the auxiliary cryogenic rectification plant 1, as will be discussed below, is recovered in such subcooling and cooling operations.

The separation of the nitrogen from the combined liquid oxygen stream 26 produces the high purity liquid oxygen within the bottom region 48 of distillation column 38 from residual liquid 60 that is produced by reboiling bottoms liquid by reboiler 46. The high purity liquid oxygen can be removed from an outlet 62 of the distillation column 56 as a high purity liquid oxygen stream. A liquid oxygen product stream 64 can be produced from part of high purity liquid oxygen stream and another portion 66 thereof can optionally be pumped in a pump 68. The pumped portion 66 can then be vaporized within one of the cryogenic air separation plants, for example, cryogenic air separation plant 16, to produce a high purity gaseous oxygen product stream 70 at pressure.

Figure 2:
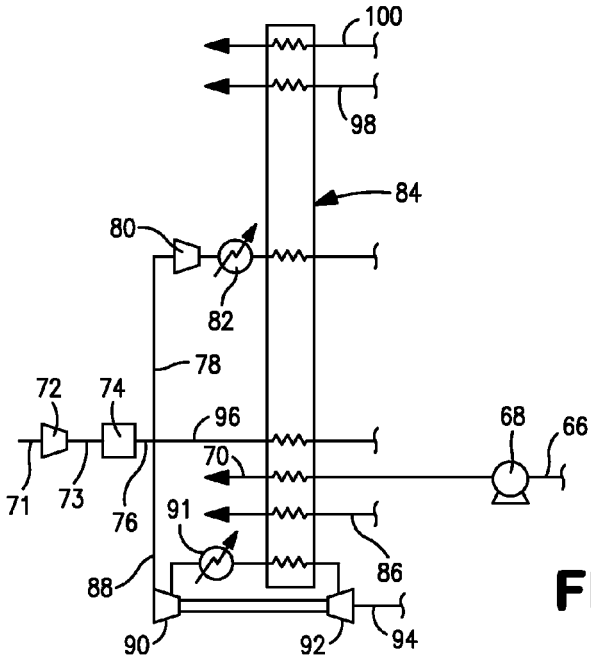
FIG. 2 is a fragmentary view of FIG. 1 illustrating a main heat exchanger of a cryogenic air separation plant.

With brief reference to FIG. 2, the production of high purity gaseous oxygen stream 70 is illustrated again for exemplary purposes in connection with the heat exchanger used within the plant illustrated in U.S. Pat. No. 5,675,977. As illustrated in this patent, an air stream 71 is compressed in a main air compressor 72 to form a compressed air stream 73 that is in turn introduced into a purification unit 74 of known design. Purification unit 74 typically contains beds of adsorbent that are operated in an out of phase cycle and that contain alumina to remove moisture, carbon dioxide and hydrocarbons from the compressed air stream 72. The resulting compressed and purified air stream 76 is divided into a first portion 78 that is further compressed within a booster compressor 80 and after removal of the heat of compression by an after-cooler 82 is introduced into a main heat exchanger 84 to be condensed against vaporizing a pumped liquid oxygen stream 86. A second portion 88 of the compressed and purified air stream 76 is also further compressed within a booster compressor 90 and after removal of the heat of compression within an after-cooler 91 and partial cooling within main heat exchanger 84, is introduced into a turboexpander 92 and expanded to produce an exhaust stream 94. Exhaust stream 94 is introduced into a low pressure column of such plant to impart the refrigeration contained in such exhaust stream 94. A third portion 96 of compressed and purified air 78 after having been cooled within main heat exchanger 84 is introduced into the high pressure column of such plant for rectification. High and low pressure gaseous nitrogen product streams 98 and 100, produced from nitrogen-rich column overhead in the high pressure column and the low pressure column, respectively, are fully warmed within main heat exchanger 84. When used in connection with the present invention and in particular, the illustrated embodiment thereof, the main heat exchanger is modified with passes to receive pumped high purity liquid oxygen stream 66 to form high purity gaseous oxygen stream 70. It is to be noted, that as would occur to those skilled in the art, main heat exchangers used in cryogenic air separation plants of different design could be modified in a like manner to vaporize high purity oxygen.

Optionally, a liquid argon product can be produced. In this regard, argon containing stream 100 can be withdrawn from distillation column 38 and introduced into argon column 102 ("Argon Column") to separate oxygen from argon and thereby to produce an argon-rich column overhead in a top region 104 of argon column 102 and an oxygen-rich liquid column bottoms 106 within a bottom region of argon column 102. An argon-rich vapor stream 108 composed of the argon-rich column overhead is introduced into a heat exchanger 110 located within a shell 112 and condensed through indirect heat exchange with a heat exchange stream 114 that as a liquid is removed from distillation column 38 and introduced into shell 112. This heat exchange forms a condensed argon stream 116 that is reintroduced into argon column 102 as reflux. Part of the argon-rich liquid can be taken as an argon product stream 118. The heat exchange stream 114 is vaporized and as a vaporized heat exchange stream 120 is introduced back into distillation column 38. Additionally, an oxygen-rich liquid stream 122 that is formed from the oxygen-rich liquid column bottoms 106 can be pumped by a pump 124 and reintroduced as a pump stream 126 back into distillation column 38.

Distillation column 38 and argon column 104 as well as their associated heat exchangers are located within their own cold box. As such, in order to compensate for heat leakage, refrigeration must be imparted. In the illustrated embodiment refrigeration is introduced by way of a nitrogen liquid stream 128 into top region 56 of distillation column 38. Nitrogen liquid stream 128 could also be formed from liquid produced in one of the cryogenic air separation plants 10-16 and stored in a storage tank, not illustrated. Other means of generating refrigeration could be provided, for example, a recycle liquefier or high pressure expansion could be used to liquefy nitrogen-rich stream 58 to produce nitrogen liquid stream 128. Additionally, other types of refrigeration could be supplied, for example, closed loop refrigeration cycles to supply a refrigerant at cryogenic temperature.

The follow table is a calculated example illustrating the operation of the apparatus illustrated in FIG. 1.

TABLE

| | Stream number | | |
|---|---|---|---|
| | 41 | 41 after passage through heat exchanger 44 | 50 |
| Vapor Fraction | 1.0 | 1.0 | 0 |
| Molar Flow (CFH-NTP) | 6.47E+06 | 6.47E+06 | 6.47E+06 |
| Pressure (psia) | 78 | 78 | 78 |
| Temperature (K) | 300 | 101.9 | 94.93 |
| Master Comp Mole Frac (Nitrogen) | 9.96E−01 | 9.96E−01 | 9.96E−01 |
| Master Comp Mole Frac (Oxygen) | 2.50E−03 | 2.50E−03 | 2.50E−03 |
| Master Comp Mole Frac (Argon) | 1.50E−03 | 1.50E−03 | 1.50E−03 |

| | Stream number | | |
|---|---|---|---|
| | 50 after passage through subcooling unit 52 | 58 before passage through subcooling unit 52 | 58 after passage through subcooling unit 52 |
| Vapor Fraction | 0 | 1.0 | 1.0 |
| Molar Flow (CFH-NTP) | 6.47E+06 | 6.51E+06 | 6.51E+06 |
| Pressure (psia) | 78 | 18 | 18 |
| Temperature (K) | 87 | 79.14 | 93.93 |
| Master Comp Mole Frac (Nitrogen) | 9.96E−01 | 9.99E−01 | 9.99E−01 |
| Master Comp Mole Frac (Oxygen) | 2.50E−03 | 7.19E−04 | 7.19E−04 |
| Master Comp Mole Frac (Argon) | 1.50E−03 | 6.04E−04 | 6.04E−04 |

| | Stream number | | |
|---|---|---|---|
| | 58 after passage through heat exchanger 44 | 26 | 62 |
| Vapor Fraction | 1 | 0 | 0 |
| Molar Flow (CFH-NTP) | 6.51E+06 | 1.52E+06 | 1.46E+06 |
| Pressure (psia) | 18 | 20 | 19.5 |
| Temperature (K) | 297.2 | 92.48 | 92.94 |
| Master Comp Mole Frac (Nitrogen) | 9.99E−01 | 2.00E−02 | 0.00E+00 |
| Master Comp Mole Frac (Oxygen) | 7.19E−04 | 9.50E−01 | 9.95E−01 |
| Master Comp Mole Frac (Argon) | 6.04E−04 | 3.00E−02 | 5.00E−03 |

TABLE-continued

| | Stream number | | |
|---|---|---|---|
| | 64 | 66 | 66 after pump 68 |
| Vapor Fraction | 0 | 0 | 0 |
| Molar Flow (CFH-NTP) | 3.36E+05 | 1.12E+06 | 1.12E+06 |
| Pressure (psia) | 19.5 | 19.5 | 377.3 |
| Temperature (K) | 92.94 | 92.94 | 92.94 |
| Master Comp Mole Frac (Nitrogen) | 0.00E+00 | 0.00E+00 | 0.00E+00 |
| Master Comp Mole Frac (Oxygen) | 9.95E−01 | 9.95E−01 | 9.95E−01 |
| Master Comp Mole Frac (Argon) | 5.00E−03 | 5.00E−03 | 5.00E−03 |

| | Stream number | | |
|---|---|---|---|
| | 70 | 100 | 122 |
| Vapor Fraction | 1 | 1 | 0 |
| Molar Flow (CFH-NTP) | 1.12E+06 | 2.03E+06 | 1.99E+06 |
| Pressure (psia) | 377.3 | 19.12 | 19.3 |
| Temperature (K) | 92.94 | 92.52 | 92.6 |
| Master Comp Mole Frac (Nitrogen) | 0.00E+00 | 0.00E+00 | 0.00E+00 |
| Master Comp Mole Frac (Oxygen) | 9.95E−01 | 9.32E−01 | 9.53E−01 |
| Master Comp Mole Frac (Argon) | 5.00E−03 | 6.76E−02 | 4.69E−02 |

| | Stream number | |
|---|---|---|
| | 118 | 128 |
| Vapor Fraction | 0 | 0 |
| Molar Flow (CFH-NTP) | 4.43E+04 | 3.04E+04 |
| Pressure (psia) | 18 | 80 |
| Temperature (K) | 89.26 | 85 |
| Master Comp Mole Frac (Nitrogen) | 0.000017 | 1.0 |
| Master Comp Mole Frac (Oxygen) | 0.010004 | 0 |
| Master Comp Mole Frac (Argon) | 0.989979 | 0 |

While the present invention has been described with reference to a preferred embodiment, as will occur to those skilled in the art, numerous changes, additions and omissions can be made without departing from the spirit and scope of the present invention as set forth in the appended claims.

We claim:

1. A method of producing high purity oxygen comprising:

withdrawing low purity liquid oxygen streams and gaseous nitrogen streams from a plurality of cryogenic air separation plants;

introducing a combined low purity liquid oxygen stream formed from the low purity liquid oxygen streams and a combined gaseous nitrogen stream formed from the gaseous nitrogen streams into an auxiliary cryogenic rectification plant;

separating nitrogen from the combined low purity liquid oxygen stream within a distillation column of the auxiliary cryogenic rectification plant such that the high purity oxygen is formed of residual liquid produced by reboiling bottoms liquid in a bottom region of the distillation column, reboiling the bottoms liquid with the combined gaseous nitrogen stream, thereby to condense the combined gaseous nitrogen stream and to form a liquid nitrogen stream and introducing the liquid nitrogen stream into a top region of the distillation column as reflux;

imparting refrigeration to the auxiliary cryogenic rectification plant and recovering the refrigeration through subcooling the liquid nitrogen stream and thereafter cooling the combined gaseous nitrogen stream through indirect heat exchange with a nitrogen-rich vapor stream withdrawn from a top region of the distillation column; and withdrawing the high purity oxygen from the bottom region of the distillation column as a high purity liquid oxygen stream.

2. The method of claim 1, wherein the combined gaseous nitrogen stream is compressed prior to being cooled and heat of compression is removed from the combined gaseous nitrogen stream.

3. The method of claim 1, wherein refrigeration is imparted to the auxiliary cryogenic rectification plant by introducing a liquid nitrogen refrigerant stream into the distillation column as part of the reflux.

4. The method of claim 1, wherein:

an argon containing stream is withdrawn from the distillation column and introduced into an argon column of the auxiliary cryogenic rectification plant to separate oxygen from argon and thereby produce an argon-rich column overhead and an oxygen-rich liquid column bottoms;

an argon-rich vapor stream composed of the argon-rich column overhead is condensed to form an argon-rich liquid through indirect heat exchange with a heat exchange stream withdrawn from the distillation column, thereby to form a vaporized heat exchange stream;

an argon-rich liquid product stream is formed from part of the argon-rich liquid and a remaining part of the argon-rich liquid is introduced into the argon column as an argon reflux stream; and the vaporized heat exchange stream and an oxygen-rich liquid stream composed of the oxygen-rich liquid column bottoms is introduced back into the distillation column.

5. The method of claim 1, wherein:

part of the high purity liquid oxygen stream is pumped to form a pumped liquid oxygen stream; and the pumped liquid oxygen stream is vaporized within a main heat exchanger associated with one of the cryogenic air separation plants.

6. An apparatus for producing high purity oxygen comprising:

an auxiliary cryogenic rectification plant connected to a plurality of cryogenic air separation plants to receive a combined low purity liquid oxygen stream formed from the low purity liquid oxygen streams produced by the cryogenic air separation plants and a combined gaseous nitrogen stream formed from the gaseous nitrogen streams produced by the cryogenic air separation plants;

the auxiliary cryogenic rectification plant having a distillation column configured such that nitrogen is separated from the combined low purity oxygen stream and the high purity oxygen is formed from residual liquid produced from reboiling bottoms liquid in a bottom region of the distillation column, a reboiler located in a bottom region of the distillation column and positioned such that the combined gaseous nitrogen stream passes through the reboiler, reboils the bottoms liquid, thereby produces a liquid nitrogen stream and the liquid nitrogen stream is introduced into the top region of the distillation column as reflux, a heat exchanger connected to the reboiler such that the combined gaseous nitrogen stream is cooled prior to passing into the reboiler and a subcooling unit positioned between the reboiler and the top region of the distillation column such that the liquid nitrogen stream is subcooled prior to being introduced into the top region of the distillation column;

means for imparting refrigeration to the auxiliary cryogenic rectification plant;

the subcooling unit connected to the top region of the distillation column and the heat exchanger connected to the subcooling unit such that a nitrogen-rich stream produced at the top region of the distillation column passes in indirect heat exchange with the liquid nitrogen stream and thereafter, the combined gaseous nitrogen stream and the refrigeration is thereby recovered in subcooling the liquid nitrogen stream and in cooling the combined gaseous nitrogen stream; and the distillation column having, at the bottom region thereof, an outlet to discharge the high purity oxygen as a high purity liquid oxygen stream.

7. The apparatus of claim 6, wherein:

a compressor is positioned between the cryogenic air separation plants and the auxiliary cryogenic rectification plant such that the combined gaseous nitrogen stream is compressed; and an after-cooler is connected to the compressor to remove the heat of compression from the combined gaseous nitrogen stream after having been compressed.

8. The apparatus of claim 6, wherein the refrigeration imparting means is a liquid nitrogen refrigerant stream introduced into the top region of the distillation column as part of the reflux.

9. The apparatus of claim 6, wherein:

the auxiliary cryogenic rectification plant has an argon column connected to the distillation column and a condenser connected to the argon column;

the argon column configured such that a argon containing stream is withdrawn from the distillation column and introduced into the argon column and oxygen is separated from argon, thereby to produce, within the argon column, an argon-rich column overhead and an oxygen-rich liquid column bottoms;

the argon column also connected to the distillation column such that an oxygen-rich liquid stream composed of the oxygen-rich liquid column bottoms is introduced back into the distillation column; and the condenser is connected to the distillation column and the argon column such that an argon-rich vapor stream combined of the argon-rich column overhead is condensed to form an argon-rich liquid through indirect heat exchange with a heat exchange stream withdrawn from the distillation column, thereby to form a vaporized heat exchange stream, the vaporized heat exchange stream is returned to the distillation column, an argon-rich liquid product stream is formed from part of the argon-rich liquid and a remaining part of the argon-rich liquid is introduced into the argon column as an argon reflux stream.

10. The apparatus of claim 6, wherein:

a pump is in flow communication with the outlet of the distillation column so that part of the high purity liquid oxygen stream is pumped to form a pumped liquid oxygen stream; and a main heat exchanger associated with one of the cryogenic air separation plants is connected to the pump so that the pumped liquid oxygen stream vaporizes within the heat exchanger.

* * * * *